US007879163B2

(12) United States Patent
Nakamura et al.

(10) Patent No.: US 7,879,163 B2
(45) Date of Patent: Feb. 1, 2011

(54) METHOD FOR MANUFACTURING A HIGH CARBON HOT-ROLLED STEEL SHEET

(75) Inventors: Nobuyuki Nakamura, Hiroshima (JP); Takeshi Fujita, Chiba (JP); Yoshiro Tsuchiya, Hiroshima (JP); Shunji Ilzuka, Hiroshima (JP); Saiji Matsuoka, Hiroshima (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 12/291,118

(22) Filed: Nov. 6, 2008

(65) Prior Publication Data

US 2009/0071578 A1 Mar. 19, 2009

Related U.S. Application Data

(62) Division of application No. 11/064,049, filed on Feb. 22, 2005, now abandoned.

(30) Foreign Application Priority Data

Mar. 10, 2004 (JP) ..... 2004-067119

(51) Int. Cl.
*C21D 8/02* (2006.01)

(52) U.S. Cl. ..... 148/602

(58) Field of Classification Search ..... 148/602
See application file for complete search history.

(56) References Cited

U.S. PATENT DOCUMENTS 4,871,146 A * 10/1989 Yamada et al. ..... 266/106
5,108,518 A 4/1992 Fukui et al.

FOREIGN PATENT DOCUMENTS

| | | | |
|---|---|---|---|
| JP | 11-269552 | A | 10/1999 |
| JP | 11-269553 | A | 10/1999 |
| JP | 2003-13145 | A | 1/2003 |

OTHER PUBLICATIONS

English-language translation of JP 2003-13145.
Won Jong Nam, "Effect on Initial Microstructure on the Coarsening Behavior of Cementite Particles,", *ISIJ International*, vol. 39 (1999), No. 11, pp. 1181-1187.
Hiroshi Wakata et al., "Homogenization of the Microstructure of Hot Rolled High Carbon Steel Sheet with Controlled Cooling (Development on High Carbon Hot Rolled Steel Sheet with Excellent Formability-1)," JFE Steel Research Laboratory, JFE Steel Corp., *CAMP-ISIJ*, vol. 17 (2004), 503-504 and an English-language translation thereof.

* cited by examiner

*Primary Examiner*—Roy King
*Assistant Examiner*—Jie Yang
(74) *Attorney, Agent, or Firm*—DLA Piper LLP (US)

(57) ABSTRACT

A method for manufacturing a high carbon hot-rolled steel sheet. The method including the steps of hot-rolling, primary cooling, secondary cooling, coiling, acid-washing and annealing. The primary cooling step is to cool the hot-rolled steel sheet down to a cooling termination temperature of 450° C. to 600° C. at a cooling rate of higher than 120° C./sec. The secondary cooling step is to apply a secondary cooling to hold the primarily cooled hot-rolled steel sheet at a temperature of 450° C. to 650° C. until coiling.

4 Claims, No Drawings

METHOD FOR MANUFACTURING A HIGH CARBON HOT-ROLLED STEEL SHEET

CROSS-REFERENCE TO RELATED APPLICATION

This application is a Divisional application of application Ser. No. 11/064,049 filed Feb. 22, 2005, now abandoned the entire contents of which are hereby incorporated by reference herein.

FIELD OF THE INVENTION

The present invention relates to a high carbon hot-rolled steel sheet having excellent ductility and stretch-flange formability, and a manufacturing method thereof.

DESCRIPTION OF THE RELATED ARTS

High carbon steel sheets employed for tools, automobile parts (gear, transmission), and the like are subjected to heat treatment such as quenching and tempering after punching and forming thereof. The requests of users who conduct the working on these components include improvement in bore expansion (burring) property in the forming process after punching, as well as the elongation characteristic which is an index of ductility for forming the steel sheet into complex shapes. The burring property is evaluated by the stretch-flange formability as one of press-forming properties. Consequently, there are wanted the materials having excellent stretch-flange formability as well as ductility.

Regarding the improvement in the stretch-flange formability of high carbon steel sheets, several technologies have been studied. For example, JP-A-11-269552 and JP-A-11-269553, (the term "JP-A" referred to herein signifies the "Japanese Patent Laid-Open Publication"), disclose a method for manufacturing medium to high carbon steel sheets having excellent stretch-flange formability in a process after cold-rolling. The disclosed technology employs a hot-rolled steel which contains 0.1 to 0.8% C by mass, having a metallic structure substantially consisting of ferrite phase and pearlite phase, having, at need, the area rate of proeutectoid ferrite of at or higher value determined by the C content (% by mass), and having 0.1 μm or larger distance between pearlite lamellas. To the hot-rolled steel sheet, cold-rolling is given by 15% or higher rolling rate, followed by three-stage or two-stage annealing while holding the steel sheet in three steps or two steps of temperature ranges for a long time.

Also JP-A-2003-13145 discloses a method for manufacturing a high carbon steel sheet having excellent stretch-flange formability, which contains 0.2 to 0.7% C by mass, has average grain size of carbide in a range from 0.1 to 1.2 μm, and has a volume ratio of carbide-free ferrite grains of 10% or less. The disclosed technology is a process in which the hot-rolling is given at finishing temperatures of ($Ar_3$ transformation point −20° C.) or above, the cooling is given to cooling termination temperatures of 650° C. or below at cooling rates of higher than 120° C./sec, the coiling is given at temperatures of 600° C. or below, the acid washing is given, and then the annealing is given at annealing temperatures ranging from 640° C. to $Ac_1$ transformation point.

According to the technologies disclosed in JP-A-11-269552 and JP-A-11-269553, the ferrite structure is made by the proeutectoid ferrite and does not include carbide. As a result, the stretch-flange formability is not necessarily favorable, though the material is soft and shows excellent ductility. A presumable reason of the phenomenon is the following. During punching the steel sheet, the area of proeutectoid ferrite significantly deforms in the vicinity of a punched end face, which induces significant difference between the deformation of the proeutectoid ferrite and that of the ferrite containing spheroid carbide. As a result, stress concentrates to the peripheral zones of grain boundary where the deformation significantly differs therebetween, thereby generating voids at interface between the spheroid structure and the ferrite. Since the voids grow to cracks, the stretch-flange formability is ultimately deteriorated.

A countermeasure to the phenomenon may be the one to apply strengthened spheroidizing annealing, thereby softening the entire structure. In this measure, however, the spheroidized carbide becomes coarse to become the origin of void during the forming step, and the carbide becomes less soluble in the heat treatment step after the forming to cause the decrease in quenched strength.

Furthermore, recent requirement for the forming level has increased more than ever from the point of increase in productivity. Consequently, burring in high carbon steel sheet also likely induces crack generation at punched end face caused by the advanced level of forming. Therefore, the high carbon steel sheets are also requested to have high stretch-flange formability.

In this regard, the inventors of the present invention developed a technology disclosed in JP-A-2003-13145 aiming to provide a high carbon steel sheet having excellent stretch-flange formability and inducing very few cracks at punched end face, which steel sheet is manufactured without applying time-consuming multi-stage annealing. The technology allowed manufacturing a high carbon hot-rolled steel sheet having excellent stretch-flange formability.

On the other hand, recent uses of driving system components and the like request increased strength also in the non-heat treating parts, specifically in integrally formed components for attaining higher durability and lighter weight, thus the steel sheets as the starting material are requested to have 440 MPa or higher tensile strength (TS). That kind of request with the aim to reduce the manufacturing cost of components has led a request to supply hot-rolled steel sheets.

The integral forming process has more than ten pressing steps, and is conducted in a complex combination of forming modes including not only burring but also stretching and bending. Accordingly, the integral forming has faced the simultaneous requests of stretch-flange ability and elongation.

According to the technology disclosed in JP-A-2003-13145, however, achieving TS=440 MPa (73 point or more as HRB hardness) not necessarily attains satisfactory stretch-flange formability. That is, the technology cannot satisfy stably the requirements of both that level of TS and the stretch-flange formability. Furthermore, the disclosed technology does not refer to the elongation.

Adding to the above technology, the technology disclosed in JP-A-2003-13145 generates transformation heat after cooling, which increases the temperature to enhance the precipitation of proeutectoid ferrite and the pearlite transformation, thereby inducing growth of coarse carbide and uneven carbide distribution to likely deteriorate the characteristics.

SUMMARY OF THE INVENTION

It is an object of the present invention to provide a high carbon hot-rolled steel sheet having 440 MPa or higher tensile strength and giving excellent ductility and stretch-flange formability, generating very few cracks at punched end face, and which steel sheet can be manufactured without applying time-consuming multi-stage annealing.

The inventors of the present invention conduced intensive studies on the effect of components and microscopic structures of high carbon steel sheet on ductility and stretch-flange formability while securing strength thereof, and found that the ductility and the stretch-flange formability of steel sheet are significantly affected by not only the composition of the steel, the shape and quantity of carbide, but also the dispersed state of carbide. That is, it was found that the ductility and the stretch-flange formability of high carbon hot-rolled steel sheet are improved by controlling each of the carbide shape in terms of average grain size of carbide and volume ratio of carbide having 2.0 μm or larger grain size, and the dispersed state of carbide in terms of volume ratio of carbide-free ferrite grains and average grain size of ferrite.

The present invention provides a high carbon hot-rolled steel sheet consisting essentially of, in terms of percentages of mass, 0.10 to 0.7% C, 2.0% or less Si, 0.20 to 2.0% Mn, 0.03% or less P, 0.03% or less S, 0.1% or less Sol.Al, 0.01% or less N, and balance of Fe and inevitable impurities, and having a structure of ferrite having 6 μm or smaller average grain size and carbide having 0.10 μm or larger and smaller than 1.2 μm of average grain size. The volume ratio of the carbide having 2.0 μm or larger grain size is 10% or less, and the volume ratio of the ferrite containing no carbide is 5% or less. The high carbon steel sheet gives excellent ductility and stretch-flange formability.

The high carbon hot-rolled steel sheet may further contain at least one element selected from the group consisting of, in terms of percentages of mass, 0.05 to 1.5% Cr and 0.01 to 0.5% Mo.

The high carbon hot-rolled steel sheet may further contain at least one element selected from the group consisting of, in terms of percentages of mass, 0.005% or less B, 1.0% or less Cu, 1.0% or less Ni, and 0.5% or less W.

The high carbon hot-rolled steel sheet may further contain at least one element selected from the group consisting of, in terms of percentages of mass, 0.05 to 1.5% Cr and 0.01 to 0.5% Mo, and further at least one element selected from the group consisting of, in terms of percentages of mass, 0.005% or less B, 1.0% or less Cu, 1.0% or less Ni, and 0.5% or less W.

The high carbon hot-rolled steel sheet may further contain at least one element selected from the group consisting of, in terms of percentages of mass, 0.5% or less Ti, 0.5% or less Nb, 0.5% or less V, and 0.5% or less Zr.

The content of Si is preferably from 0.005 to 2.0% by mass. From the point of securing strength after annealing, the Si content is more preferably 0.02% or more. From the point of surface property, the Si content is more preferably 0.5% or less.

The content of Mn is preferably from 0.2 to 1.0% by mass.

A preferable range of the content of Cr is determined from the viewpoint of securing sufficient strength after quenching. Under a condition of securing satisfactory cooling rate in quenching treatment, the content of Cr is preferably from 0.05 to 0.3% by mass. When the strength after quenching is strictly required even under varied cooling rate in the quenching treatment, the Cr content is preferably from 0.8 to 1.5% by mass.

The content of Mo is preferably from 0.05 to 0.5% by mass.

The present invention further provides a method for manufacturing high carbon hot-rolled steel sheet, having the steps of hot-rolling, primary cooling, holding, coiling, acid washing, and annealing.

The hot-rolling step applies hot-rolling to a steel consisting essentially of, in terms of percentages of mass, 0.10 to 0.70% C, 2.0% or less Si, 0.20 to 2.0% Mn, 0.03% or less P, 0.03% or less S, 0.1% or less Sol.Al, 0.01% or less N, and balance of Fe and inevitable impurities, at finishing temperatures of ($Ar_3$ transformation point −10° C.) or above.

The steel may further contain at least one element selected from the group consisting of, in terms of percentages of mass, 0.05 to 1.5% Cr and 0.01 to 0.5% Mo.

The steel may further contain at least one element selected from the group consisting of, in terms of percentages of mass, 0.005% or less B, 1.0% or less Cu, 1.0% or less Ni, and 0.5% or less W.

The steel may further contain at least one element selected from the group consisting of, in terms of percentages of mass, 0.05 to 1.5% Cr and 0.01 to 0.5% Mo, and further at least one element selected from the group consisting of, in terms of percentages of mass, 0.005% or less B, 1.0% or less Cu, 1.0% or less Ni, and 0.5% or less W.

The steel may further contain at least one element selected from the group consisting of, in terms of percentages of mass, 0.5% or less Ti, 0.5% or less Nb, 0.5% or less V, and 0.5% or less Zr.

The primary cooling step is primary cooling of a hot-rolled steel sheet down to the cooling termination temperatures ranging from 450° C. to 600° C. at cooling rates of higher than 120° C./sec. The upper limit of the cooling rate is preferably 700° C./sec from the point of facility capacity.

The holding step is to hold the cooled hot-rolled steel sheet in a temperature range from 450° C. to 650° C. by the secondary cooling until coiling.

The coiling step is to coil the cooled hot-rolled steel sheet at coiling temperatures of 600° C. or below. The coiling temperature is preferably in a range from 200° C. to 600° C.

The acid washing step is to apply acid washing to the coiled hot-rolled steel sheet.

The annealing step is to anneal the hot-rolled steel sheet after the acid washing at temperatures ranging from 680° C. to $Ac_1$ transformation point.

The percentage indicating the composition of steel, referred to herein, is percentage by mass.

The present invention suppresses the generation of voids at punched end face during-punching, and delays the growth of cracks during burring. As a result, the present invention provides a high carbon hot-rolled steel sheet having 440 MPa or higher tensile strength and extremely excellent ductility and stretch-flange formability. By applying the high carbon hot-rolled steel sheet having excellent ductility and stretch-flange formability according to the present invention to highly durable parts such as transmission parts represented by gear, advanced level of forming is attained in the forming step, which provides high product quality and allows manufacturing the parts at low cost with decreased number of manufacturing steps. Also for the parts of driving system, the integrally formed components are requested to have increased strength in the non-heat treating parts for attaining higher durability and lighter weight, thus the steel sheets as the starting material are requested to have 440 MPa class tensile strength (TS). The high carbon hot-rolled steel sheet according to the present invention is useful in this respect.

DESCRIPTION OF THE EMBODIMENTS

The high carbon hot-rolled steel sheet according to the present invention consists essentially of, in terms of percentages of mass, 0.1 to 0.7% C, 2.0% or less Si, 0.2 to 2.0% Mn, 0.03% or less P, 0.03% or less S, 0.1% or less Sol.Al, 0.01% or less N, and balance of Fe and inevitable impurities, and has a structure of ferrite having 6 μm or smaller average grain size and carbide having 0.10 μm or more and less than 1.2 μm of average grain size, wherein the volume ratio of the carbide having 2.0 μm or larger grain size is 10% or less, and the volume ratio of the ferrite containing no carbide is 5% or less. The above specification of the steel sheet is most important parameter of the present invention. With thus specified chemical composition, metallic structure (average grain size of ferrite), shape of carbide (volume ratio of carbide having 2.0 μm or larger average grain size), and dispersion state of carbide (volume ratio of carbide-free ferrite grains), and by satisfying all of these specifications, a high carbon hot-rolled steel sheet having excellent ductility and stretch-flange formability is obtained.

The high carbon hot-rolled steel sheet according to the present invention may further contain one or both of, in terms of percentage by mass, 0.05 to 1.5% C and 0.01 to 0.5% Mo, may further contain one or more of, in terms of percentage by mass, 0.005% or less B, 1.0% or less Cu, 1.0% or less Ni, and 0.5% or less W, and may further contain one or more of, in terms of percentage by mass, 0.5% or less Ti, 0.5% or less Nb, 0.5% or less V, and 0.5% or less Zr.

The high carbon hot-rolled steel sheet can be manufactured by the steps of: hot-rolling the steel at finishing temperatures of ($Ar_3$ transformation point −10° C.) or above; applying primary cooling to the hot-rolled steel sheet down to cooling termination temperatures ranging from 450° C. to 600° C. at cooling rates of higher than 120° C./sec; applying secondary cooling to hold the primarily cooled hot-rolled steel sheet in a temperature range from 450° C. to 650° C. until coiling; coiling the cooled hot-rolled steel sheet at coiling temperatures of 600° C. or below; applying acid washing to the coiled hot-rolled steel sheet; and annealing the acid-washed hot-rolled steel sheet at annealing temperatures ranging from 680° C. to $Ac_1$ transformation point. The object of the invention is attained by totally controlling the conditions of, after the hot-rolling, primary cooling, secondary cooling, coiling, and annealing.

The present invention is described in more detail in the following.

The reasons to limit the chemical composition of the steel according to the present invention are described below.

C: 0.1 to 0.7%

Carbon is an important element that forms carbide and provides hardness after quenching. However, the C content of less than 0.1% causes conspicuous formation of proeutectoid ferrite in the structure after the hot-rolling, which results in uneven carbide distribution. In such a case, strength sufficient for structural machine parts cannot be obtained even after quenching. On the other hand, the C content exceeding 0.7% results in insufficient working property, giving low stretch-flange formability and ductility. In such a case, the steel sheet after the hot-rolling shows high hardness and becomes brittle so that the strength after quenching saturates. Therefore, the C content is specified to a range from 0.1 to 0.7%. From the point of securing sufficient strength after quenching, the C content is preferably 0.2% or more, and from the point of handling of steel sheet on and after coiling, the C content is preferably 0.6% or less. The C content condition is an important parameter of the present invention.

Si: 2.0% or Less

Since Si is an element to improve the quenching property and increase the material strength by solid solution strengthening, the Si content is preferably 0.005% or more. However, The Si content exceeding 2.0% facilitates formation of proeutectoid ferrite and increases the ferrite grains substantially free from carbide, thereby deteriorating the stretch-flange formability. Furthermore, Si has a tendency of graphitizing carbide and likely hinders quenching property. Consequently, the Si content is specified to 2.0% or less, preferably 0.02% or more from the point of securing strength after annealing, and preferably 0.5% or less from the point of surface property.

Mn: 0.2 to 2.0%

Similar with Si, Mn is an element to improve the quenching property and to increase the material strength by solid solution strengthening. Manganese is also an important element which fixes S as MnS and prevents hot cracking of slab. However, the Mn content of less than 0.2% reduces these effects, and enhances the formation of proeutectoid ferrite to generate coarse ferrite grains, and further significantly deteriorates the quenching property. The Mn content exceeding 2.0% allows significant formation of manganese band which is a segregation zone, though a wanted tensile strength is attained, thereby deteriorating the stretch-flange formability and the elongation. Accordingly, the Mn content is specified to a range from 0.20% to 2.0%, and preferably 1.0% or less from the viewpoint of stretch-flange formability and deterioration in elongation caused by the formation of manganese band.

P: 0.03% or Less

Phosphorus is an element to be reduced because P is segregated in grain boundaries to decrease the toughness. Since, however, the P content is acceptable up to 0.03%, the P content is specified to 0.03% or less.

S: 0.03% or Less

Sulfur is an element to be reduced because S forms MnS with Mn to deteriorate the stretch-flange formability. Since, however, the S content is acceptable up to 0.03%, the S content is specified to 0.03% or less.

sol.Al: 0.1% or Less

Aluminum is added in the steel making stage as an acid-eliminating agent to improve the cleanliness of steel. Normally Al is contained in the steel in an amount of 0.005% or more as sol.Al. An Al content exceeding 0.1% as sol.Al results in the saturation of the cleanliness improving effect, thereby increasing the cost. In addition, excess Al results in large amount of AlN precipitate to deteriorate the quenching property. Therefore, the sol.Al content is specified to 0.1% or less, preferably 0.08% or less.

N: 0.01% or Less

Since excess N deteriorates the ductility, the N addition is specified to 0.01% or less.

The steel sheet according to the present invention achieves the objective characteristics with the above essential adding elements. Depending on the wanted characteristics, however, one or both of Cr and Mo may be added.

Cr: 0.05 to 1.5%

Chromium is an important element to suppress the formation of proeutectoid ferrite during cooling step after the hot-rolling, thus to improve the stretch-flange formability and improve the quenching property. However, the Cr content less than 0.05% cannot attain satisfactory effect. Furthermore, the Cr content exceeding 1.5% saturates the effect to suppress the formation of proeutectoid ferrite and increases the cost, though the quenching property is improved. Accordingly, when Cr is added, the Cr content is specified to a range from 0.05 to 1.5%. Preferably, from the point of securing sufficient strength after quenching, the Cr content is in a range from 0.05 to 0.3% under a condition that a satisfactory cooling rate is assured at quenching, and from 0.8 to 1.5% when a strict strength condition is requested after quenching even under varied cooling rate at quenching.

Mo: 0.01 to 0.5%

Molybdenum is an important element to suppress the formation of proeutectoid ferrite during the cooling step after the hot-rolling, thus to improve the stretch-flange formability and improve the quenching property. However, the Mo content of less than 0.01% cannot attain satisfactory effect. On the other hand, the Mo content exceeding 0.5% saturates the effect to suppress the formation of proeutectoid ferrite and increases the cost, though the quenching property is improved. Accordingly, when Mo is added, the Mo content is specified to a range from 0.01 to 0.5%, and preferably 0.05% or more from the point of securing sufficient strength after quenching.

The steel according to the present invention may further contain, adding to the above adding elements, one or more of B, Cu, Ni, and W, at need, to suppress the formation of proeutectoid ferrite during hot-rolling and cooling and to improve the quenching property. In such a case, less than 0.0001% B, and less than 0.01% for each of Cu, Ni, and W cannot fully attain the added effect. On the other hand, the added quantity exceeding 0.005% B, 1.0% Cu, 1.0% Ni, and 0.5% W saturates the added affect, and increases the cost. Consequently, on adding these elements, the specified content is 0.0001 to 0.005% B, 0.01 to 1.0% Cu, 0.01 to 1.0% Ni, and 0.01 to 0.5% W. Boron, however, may form a compound with N in the steel to fail in providing the effect of B itself. Therefore, the element to be added for suppressing the formation of proeutectoid ferrite during hot-rolling and cooling and for improving the quenching property is preferably selected by one or more among the elements of Cu, Ni, and W. In that case, preferable adding amount of the respective elements is similar with that given above.

The steel according to the present invention may further contain, adding to the above adding elements, one or more of Ti, Nb, V, and Zr for assuring 440 MPa or higher tensile strength by refining the ferrite grains. In that case, each content less than 0.001% cannot obtain sufficient effect of addition. On the other hand, each content exceeding 0.5% saturates the adding effect and increases the cost. Therefore, if these elements are added, the content of each one is specified to a range from 0.001 to 0.5%.

The balance to the above composition is Fe and inevitable impurities.

During the manufacturing process, various elements such as Sn and Pb may enter as impurities. Those kinds of impurities, however, do not influence the effect of the present invention.

The following is the description of the present invention in terms of metallic structure (average grain size of ferrite), shape of carbide (average grain size of carbide and volume ratio of carbide having 2.0 μm or larger average grain size), and dispersion state of carbide (volume ratio of carbide-free ferrite grains). These conditions are important parameters to obtain the high carbon hot-rolled steel sheet having excellent ductility and stretch-flange formability, and the effect of the present invention cannot be attained if any of these conditions is not satisfied, or the effect of the present invention is attained only after satisfying all of these conditions.

Average Ferrite Grain Size: 6 μm or Smaller

The average ferrite grain size is an important parameter governing the stretch-flange formability and the material strength. By refining the ferrite grains, the strength is increased without deteriorating the stretch-flange formability. More specifically, average ferrite grain sizes of 6 μm or smaller provide excellent ductility and stretch-flange formability while securing 440 MPa or higher tensile strength of the material. The average ferrite grain size can be controlled by the primary cooling termination temperature, the secondary cooling holding temperature, and the coiling temperature, after hot-rolling, which are described below.

Average Carbide Grain Size: 0.10 μm or Larger and Smaller than 1.2 μm

The average carbide grain size significantly influences the working properties in general and the void formation during burring. Thus the average carbide grain size is an important parameter of the present invention. Although smaller carbide grain sizes suppress more the void formation, average carbide grain size of smaller than 0.10 μm deteriorates the ductility with the increase in hardness, thereby deteriorating the stretch-flange formability. On the other hand, increased average carbide grain size generally improves the working property. The size exceeding 1.2 μm, however, leads to void formation during burring to deteriorate the stretch-flange formability, and further the decrease in the local ductility causes the deterioration of ductility. Consequently, the average carbide grain size is specified to a range from 0.10 μm or larger and smaller than 1.2 μm. As described below, the average carbide grain size can be controlled by the manufacturing conditions, specifically by the primary cooling termination temperature, the coiling temperature, and the annealing temperature.

Volume Ratio of Carbide Having 2.0 μm or Larger Grain Size: 10% or Less

During general working process and burring step, voids predominantly occur in the vicinity of coarse carbide. Accordingly, carbide has to be emphasized to control the average grain size and to reduce the volume ratio of coarse carbide grains, and they are also important parameters of the present invention. Even when the average carbide grain size is in a range from 0.10 μm or larger and smaller than 1.2 μm, the existence of more than 10% volume ratio of coarse carbide grains at or larger than 2.0 μm in size deteriorates the stretch-flange formability caused by the generation of voids during burring, thereby decreasing the local ductility to result in the deterioration of ductility. Consequently, the volume ratio of the carbide having 2.0 μm or larger grain size is specified to 10% or less. As described below, the carbide grain size can be controlled by the primary cooling termination temperature, the secondary cooling holding temperature, the coiling temperature, and the annealing temperature.

Volume Ratio of Carbide-Free Ferrite Grain Size: 5% or Less

Uniform dispersion of carbide relaxes the stress concentration on a punched end face during burring, thereby suppressing the void formation. In this regard, it is important to control the volume ratio of carbide-free ferrite grains. By controlling the volume ratio of carbide-free ferrite grains to 5% or less, the effect similar with the state of uniform dispersion of carbide is attained, and the stretch-flange formability is significantly improved. In addition, local ductility is improved, which then significantly improves the ductility. The term "carbide-free" referred to herein signifies that no carbide is detected in an ordinary metal structure observation (with an optical microscope). That type of ferrite grains forms a zone appeared as the proeutectoid ferrite after hot-rolling, where substantially no carbide is observed within grain even after the annealing. As described below, the state of carbide dispersion can be controlled by the manufacturing conditions, specifically by the finishing temperature, the cooling rate during cooling after the rolling, the cooling termination temperature, and the coiling temperature.

The following is the description about the manufacturing method for high carbon hot-rolled steel sheet having excellent ductility and stretch-flange formability according to the present invention.

The high carbon hot-rolled steel sheet according to the present invention is obtained by the steps of: hot-rolling a steel prepared to have the above range of chemical composition at finishing temperatures of ($Ar_3$ transformation point −10° C.) or above; applying primary cooling to the hot-rolled steel sheet down to cooling termination temperatures ranging from 450° C. to 600° C. at cooling rates of higher than 120° C./sec; applying secondary cooling to hold the primarily cooled hot-rolled steel sheet in a temperature range from 450° C. to 650° C. until coiling; coiling the cooled hot-rolled steel sheet at coiling temperatures of 600° C. or below; applying acid washing to the coiled hot-rolled steel sheet; and annealing the acid-washed hot-rolled steel sheet at annealing temperatures ranging from 680° C. to $Ac_1$ transformation point. The detail of the respective steps is described below.

Finishing Temperature: Hot-Rolling at ($Ar_3$ Transformation Point −10° C.) or Above Finishing temperature of hot-rolling below ($Ar_3$ transformation point −10° C.) enhances the ferrite transformation in a part, which increases the ferrite grains to deteriorate the ductility and the stretch-flange formability. Therefore, the finish-rolling is done at finishing temperatures of ($Ar_3$ transformation point −10° C.) or above. The condition assures uniform structure and improves the ductility and the stretch-flange formability.

Cooling-Rate: Primary Cooling at Rates of Higher than 120° C./Sec

According to the present invention, rapid cooling (primary cooling) is adopted at cooling rates of higher than 120° C./sec after hot-rolling to reduce the volume ratio of proeutectoid ferrite after transformation. Gradual cooling results in a low supercooling degree of austenite, leading to the formation of proeutectoid ferrite. In particular, 120° C./sec or smaller cooling rate gives conspicuous formation of proeutectoid ferrite, thereby resulting in the carbide-free ferrite grains exceeding 5% to deteriorate the ductility and the stretch-flange formability. Accordingly, the cooling rate after hot-rolling is specified to higher than 120° C./sec.

It is preferable to begin the primary cooling after the finish-rolling within a period of from more than 0.1 sec and less than 1.0 sec. The condition provides finer ferrite grains and precipitates such as pearlite after the transformation, thus further improving the working property.

Cooling Termination Temperature: 450° C. to 600° C.

High cooling termination temperature in the primary cooling causes proeutectoid ferrite formation and increase in the lamella spacing of pearlite. As a result, fine carbide cannot be obtained after the annealing, and the ductility and the stretch-flange formability are deteriorated. Particularly when the cooling termination temperature is higher than 600° C., the carbide-free ferrite grains increase to more than 5%, which deteriorates the ductility and the stretch-flange formability. Therefore, the cooling termination temperature after rolling is specified to 600° C. or below. Lower than 450° C. of cooling termination temperature cannot obtain the equiaxed ferrite grains, and deteriorates the working property. Therefore, the cooling termination temperature is specified to 450° C. or above.

Secondary Cooling from the Primary Cooling Termination to the Coiling: Holding at Temperatures in a Range from 450° C. to 650° C.

For the case of high carbon steel sheets, the steel sheet temperature increases after the primary cooling termination, in some cases, accompanied by the proeutectoid ferrite transformation, the pearlite transformation, and the bainite transformation. Thus, even if the primary cooling termination temperature is lower than 600° C., when the temperature in the course from the primary cooling termination to the coiling is higher than 650° C., the proeutectoid ferrite is formed, the lamella spacing of pearlite increases, and the carbide in pearlite becomes coarse. As a result, the fine carbide cannot be obtained after the annealing, and the volume ratio of carbide having 2.0 μm or larger grain size exceeds 10%, thereby deteriorating the ductility and the stretch-flange formability. If the temperature in the course from the primary cooling termination to the coiling is lower than 450° C., the equiaxed ferrite cannot be obtained to deteriorate the working property, in some cases. Therefore, it is important to control the temperature in the course from the secondary cooling to the coiling. By holding the material between the secondary cooling step and the coiling step to temperatures ranging from 450° C. to 650° C., the deterioration of ductility, of stretch-flange formability, and of working property can be prevented. The secondary cooling may be done by laminar cooling or the like.

Regarding the holding time from the primary cooling termination to the coiling, short in the time induces the generation of transformation heat after coiling, which makes the steel sheet temperature control impossible and generates coil crushing. Therefore, the holding time is preferably 5 seconds or more for completing the transformation until coiling, and preferably 60 seconds or less because excess holding time significantly deteriorates the operability.

Coiling Temperature: 600° C. or Below

Higher coiling temperature increases more the lamella spacing of pearlite. Thus, the carbide becomes coarse after the annealing. When the coiling temperature exceeds 600° C., the ductility and the stretch-flange formability deteriorate. Consequently, the coiling temperature is specified to 600° C. or below. Although the lower limit of the coiling temperature is not specifically defined, 200° C. or above is preferred because lower temperature induces more the deterioration of steel sheet shape.

Annealing Temperature: 680° C. to $Ac_1$ Transformation Point

After applying acid washing to the hot-rolled steel sheet, annealing is given for spheroidizing the carbide. The annealing temperature lower than 680° C. results in insufficient spheroidization of carbide or in forming carbide having smaller than 0.1 μm of average grain size, which deteriorates the stretch-flange formability. In addition, no equiaxed ferrite is obtained, and the working property and the ductility are deteriorated. On the other hand, annealing temperature exceeding the $Ac_1$ transformation point causes austenite formation in a part, which again generates pearlite during cooling, thereby also deteriorating the stretch-flange formability and the ductility. Consequently, the annealing temperature is specified to a range from 680° C. to $Ac_1$ transformation point.

For the composition preparation of the high carbon steel according to the present invention, either a converter or an electric furnace can be applied. The high carbon steel after the composition preparation is formed in a steel slab by block formation—block rolling or by continuous casting. The steel slab is subjected to hot-rolling. The slab heating temperature is preferably 1280° C. or below to avoid deterioration of the surface state caused by scaling. The continuously cast slab may be sent, in as-cast state, to direct-feed rolling in which the slab is rolled under heating to prevent temperature reduction. Furthermore, finish-rolling may be given during the hot-rolling step eliminating the rough-rolling. Alternatively, to secure the finishing temperature, the rolled material may be heated with a heating means such as bar heater during the hot-rolling. Also in order to accelerate spheroidization or to reduce the hardness, the coiled steel sheet may be held to the temperature with a gradual cooling cover or other means.

The annealing after hot-rolling may be conducted by box annealing or continuous annealing. Temper rolling is succeedingly executed at need. Since the temper rolling does not influence the quenching property, the condition of temper rolling is not specifically limited.

The above procedure provides a high carbon hot-rolled steel sheet having excellent ductility and stretch-flange formability. A presumable reason that the high carbon hot-rolled steel sheet according to the present invention has the excellent ductility and stretch-flange formability is the following. The stretch-flange formability is significantly affected by the internal structure of punched end face zone. It was confirmed that, particularly for the case of large amount of carbide-free ferrite grains (the proeutectoid ferrite after the hot-rolling), cracks are generated from the grain boundary with the spheroidal structure zone. When the behavior of microstructure is observed, the void formation caused by the stress concentration becomes stronger at the interface of carbide after the punching. The stress concentration is enhanced in a state of increased size of carbide grains and increased quantity of carbide-free ferrite grains. On burring, these voids are connected each other to form cracks. Further by controlling the ferrite grain size, the elongation stably increases. From the above phenomena, it is possible to reduce stress concentration, to reduce void generation, thus to provide excellent ductility and stretch-flange formability through the control of chemical composition, metallic structure (average ferrite grain size), carbide shape (volume ratio of carbide having 2.0 μm or larger average grain size), and dispersed state of carbide (volume ratio of carbide-free ferrite grains).

Example 1

Continuously cast slabs of steels having the respective chemical compositions given in Table 1 as the steel Nos. A to R were heated to 1250° C., then were subjected to hot-rolling and annealing under the respective conditions given in Table 2 to prepare steel sheets having 5.0 mm in thickness. The steel sheet Nos. 1 to 18 are the example steels prepared under the manufacturing conditions within the range of the present invention, and the steel Nos. 19 to 32 are the comparative example steels prepared under the manufacturing conditions outside the range of the present invention.

Samples were cut from thus prepared respective steel sheets, and were subjected to measurements of ferrite grain size, average carbide grain size, volume ratio of carbide having 2.02 m or larger grain size, volume ratio of carbide-free ferrite grains, hardness, and stretch-flange formability (burring ratio), and further to tensile test. The results are given in Table 3. Method and condition of each test and measurement are the following.

(1) Determination of Ferrite Grain Size, Average Carbide Grain Size, Volume Ratio of Carbide Having 2.0 μm or Larger Grain Size, and Volume Ratio of Carbide-Free Ferrite Grains A cross section along, the thickness of a sample sheet was polished, etched, and photographed by a scanning electron microscope to observe the microstructure within an area of 0.01 $mm^2$. The determination was given on the ferrite grain size, the average carbide grain size, the volume ratio of carbide having 2.0 μm or larger grain size, and the volume ratio of carbide-free ferrite grains.

(2) Determination of Hardness

The surface hardness of steel sheet was determined in accordance with JIS Z2245. Average of n=5 data was derived.

(3) Determination of Stretch-Flange Formability

A sample was punched with a punching tool having a punch diameter of $d_0$=10 mm and a die diameter of 12 mm (clearance 20%), and was subjected to a hole-expanding test. The hole-expanding test was executed by the push-up method with a cylindrical flat-bottomed punch (50 mmf, 8R)), then a hole diameter db was measured when a crack was generated across the thickness of the sheet. The hole-expanding ratio λ(%) defined by the following formula was derived.

$$\lambda=100\times(db-d_0)/d_0 \quad (1)$$

(4) Tensile Test

A JIS No. 5 sheet was cut along the direction of 90° (C direction) to the rolling direction, and was subjected to tensile test with a testing speed of 10 mm/min to determine the tensile strength and the elongation.

The present invention places the target values of: 440 MPa or higher tensile strength TS; 35% or higher elongation for a steel containing 0.10% or more and less than 0.40% C; 30% or higher elongation for a steel containing 0.40 to 0.70% C; 70% or higher hole-expanding ratio λ for a steel containing 0.10% or more and less than 0.40% C (5.0 mm of sheet thickness); and 40% or higher hole expanding ratio λ for a steel containing 0.40 to 0.70% C (5.0 mm of sheet thickness).

Table 3 shows that the example steel sheet Nos. 1 to 18 of the present invention gave 440 MPa or higher tensile strength (TS), with high hole-expanding ratio λ, thus providing excellent stretch-flange formability and elongation.

In contrast, the steel sheet Nos. 19 to 32 are the comparative example steels which were prepared under the manufacturing conditions outside the range of the present invention. The steel sheet Nos. 19, 20, 22, 23, and 24 gave the ferrite grain size larger than 6 μm so that their tensile strengths were below 440 MPa. The steel sheet Nos. 30 and 31 gave the average carbide grain size larger than 1.2 μm so that their volume ratio of carbide having larger than 2 μm of the grain size exceeded 10%, and further their volume ratio of carbide-free ferrite exceeded 5%, thus the hole-expanding ratio λ was low, and the stretch-flange formability was poor. The steel sheet Nos. 21, 25, 28, and 32 gave smaller than 0.1 μm of average carbide grain size to increase the strength so that the hole expanding ratio λ and the elongation were low compared with the target values, and the elongation and the stretch-flange formability were poor. The steel sheet Nos. 27 and 29 gave larger than 5% in the volume ratio of carbide-free ferrite so that the hole expanding ratio λ and the elongation were low compared with the target values, and the elongation and the stretch-flange formability were poor. The steel sheet No. 26 gave more than 10% of the volume ratio of carbide having 2.0 μm or larger grain size, though the average carbide grain size was in a range from 0.10 μm or larger and smaller than 1.2 μm, thus the hole expanding ratio λ and the elongation were low compared with the target values, and the stretch-flange formability and the elongation were poor.

TABLE 1

| Steel No. | C | Si | Mn | P | S | sol. Al | N | Other |
|---|---|---|---|---|---|---|---|---|
| A | 0.15 | 0.22 | 0.72 | 0.009 | 0.005 | 0.020 | 0.0038 | Cr: 1.0, Mo: 0.16 |
| B | 0.23 | 0.20 | 0.80 | 0.010 | 0.009 | 0.031 | 0.0030 | — |
| C | 0.35 | 0.21 | 0.76 | 0.014 | 0.005 | 0.028 | 0.0034 | — |
| D | 0.35 | 0.20 | 0.75 | 0.012 | 0.004 | 0.035 | 0.0036 | Cr: 1.0, Mo: 0.16 |
| E | 0.49 | 0.18 | 0.75 | 0.011 | 0.008 | 0.030 | 0.0035 | — |
| F | 0.64 | 0.22 | 0.73 | 0.012 | 0.010 | 0.021 | 0.0036 | — |
| G | 0.26 | 0.03 | 0.45 | 0.015 | 0.003 | 0.040 | 0.0050 | Cr: 0.28 |
| H | 0.26 | 0.03 | 0.45 | 0.015 | 0.003 | 0.040 | 0.0050 | Mo: 0.30 |
| I | 0.47 | 0.18 | 0.75 | 0.011 | 0.008 | 0.030 | 0.0035 | Cr: 0.15 |
| J | 0.58 | 0.20 | 0.74 | 0.015 | 0.010 | 0.021 | 0.0038 | Cr: 0.06 |
| K | 0.35 | 0.21 | 0.76 | 0.013 | 0.005 | 0.028 | 0.0034 | Cr: 0.18 |
| L | 0.35 | 0.45 | 0.76 | 0.013 | 0.005 | 0.028 | 0.0034 | Mo: 0.06 |
| M | 0.37 | 0.03 | 0.75 | 0.014 | 0.004 | 0.028 | 0.0034 | Cr: 0.28, Mo: 0.30 |
| N | 0.35 | 0.18 | 0.25 | 0.014 | 0.005 | 0.028 | 0.0034 | Mo: 0.15 |
| O | 0.35 | 0.18 | 0.95 | 0.014 | 0.005 | 0.028 | 0.0034 | Cr: 0.06, Mo: 0.06 |
| P | 0.35 | 0.20 | 0.75 | 0.014 | 0.004 | 0.031 | 0.0032 | Cr: 0.06, B: 0.0022, Cu: 0.2, Ni: 0.6, W: 0.05 |

TABLE 1-continued

| Steel No. | C | Si | Mn | P | S | sol. Al | N | Other |
|---|---|---|---|---|---|---|---|---|
| Q | 0.34 | 0.21 | 0.75 | 0.013 | 0.004 | 0.032 | 0.0034 | Cr: 0.25, Ti: 0.005, Nb: 0.008, V: 0.01, Zr: 0.01 |
| R | 0.34 | 0.21 | 0.73 | 0.013 | 0.004 | 0.030 | 0.0038 | Cr: 0.06, Mo: 0.06, Cu: 0.08, Ni: 0.02, Ti: 0.02, V: 0.05 |

TABLE 2

| Steel sheet No. | Steel No. | Rolling termination temperature (° C.) | Primary cooling starting time (sec) | Primary cooling rate (° C./sec) | Primary cooling termination temperature (° C.) | Range of holding temperature In the secondary cooling until the coiling (° C.) | Coiling temperature (° C.) | Annealing condition | Remark |
|---|---|---|---|---|---|---|---|---|---|
| 1 | A | Ar3 + 30° C. | 0.5 | 220 | 590 | 550~590 | 550 | 680° C. × 40 hr | Example |
| 2 | B | Ar3 + 30° C. | 1.2 | 230 | 590 | 570~620 | 580 | 680° C. × 40 hr | Example |
| 3 | C | Ar3 + 20° C. | 1.0 | 210 | 560 | 480~550 | 540 | 680° C. × 40 hr | Example |
| 4 | D | Ar3 + 20° C. | 1.0 | 200 | 550 | 490~530 | 540 | 680° C. × 40 hr | Example |
| 5 | E | Ar3 + 30° C. | 1.2 | 200 | 570 | 520~630 | 550 | 710° C. × 40 hr | Example |
| 6 | F | Ar3 + 40° C. | 0.4 | 200 | 580 | 580~640 | 560 | 700° C. × 40 hr | Example |
| 7 | G | Ar3 + 20° C. | 1.1 | 210 | 590 | 580~630 | 560 | 680° C. × 40 hr | Example |
| 8 | H | Ar3 + 20° C. | 1.1 | 220 | 580 | 580~620 | 570 | 680° C. × 40 hr | Example |
| 9 | I | Ar3 + 30° C. | 1.2 | 210 | 560 | 530~630 | 560 | 680° C. × 40 hr | Example |
| 10 | J | Ar3 + 20° C. | 1.1 | 200 | 570 | 540~620 | 550 | 680° C. × 40 hr | Example |
| 11 | K | Ar3 + 20° C. | 1.0 | 210 | 560 | 480~550 | 550 | 680° C. × 40 hr | Example |
| 12 | L | Ar3 + 20° C. | 1.0 | 210 | 570 | 480~570 | 570 | 680° C. × 40 hr | Example |
| 13 | M | Ar3 + 20° C. | 1.0 | 210 | 560 | 480~550 | 560 | 680° C. × 40 hr | Example |
| 14 | N | Ar3 + 20° C. | 1.0 | 210 | 560 | 480~540 | 550 | 680° C. × 40 hr | Example |
| 15 | O | Ar3 + 20° C. | 1.0 | 210 | 570 | 480~550 | 560 | 680° C. × 40 hr | Example |
| 16 | P | Ar3 + 20° C. | 1.0 | 210 | 560 | 490~580 | 560 | 680° C. × 40 hr | Example |
| 17 | Q | Ar3 + 20° C. | 1.0 | 210 | 560 | 500~570 | 560 | 680° C. × 40 hr | Example |
| 18 | R | Ar3 + 20° C. | 1.0 | 210 | 560 | 500~570 | 560 | 680° C. × 40 hr | Example |
| 19 | A | Ar3 + 30° C. | 0.5 | 180 | 680 | 620~650 | 600 | 680° C. × 40 hr | Comparative Example |
| 20 | A | Ar3 − 40° C. | 1.2 | 180 | 590 | 580~630 | 590 | 680° C. × 40 hr | Comparative Example |
| 21 | A | Ar3 + 10° C. | 0.5 | 280 | 430 | 420~500 | 500 | 660° C. × 40 hr | Comparative Example |
| 22 | B | Ar3 + 30° C. | 1.2 | 210 | 630 | 580~660 | 580 | 680° C. × 40 hr | Comparative Example |
| 23 | B | Ar3 − 40° C. | 0.7 | 160 | 630 | 560~620 | 570 | 700° C. × 40 hr | Comparative Example |
| 24 | B | Ar3 + 20° C. | 1.2 | 80 | 610 | 550~600 | 540 | 680° C. × 40 hr | Comparative Example |
| 25 | C | Ar3 + 30° C. | 0.8 | 220 | 580 | 470~550 | 460 | 600° C. × 20 hr | Comparative Example |
| 26 | C | Ar3 + 20° C. | 1.0 | 210 | 580 | 550~680 | 600 | 680° C. × 40 hr | Comparative Example |
| 27 | D | Ar3 − 30° C. | 1.2 | 160 | 590 | 580~640 | 590 | 680° C. × 40 hr | Comparative Example |
| 28 | D | Ar3 + 20° C. | 0.5 | 280 | 420 | 410~510 | 500 | 660° C. × 40 hr | Comparative Example |
| 29 | E | Ar3 − 30° C. | 1.2 | 160 | 580 | 550~630 | 520 | 700° C. × 40 hr | Comparative Example |
| 30 | E | Ar3 + 30° C. | 0.7 | 200 | 660 | 610~650 | 600 | 700° C. × 40 hr | Comparative Example |
| 31 | F | Ar3 + 20° C. | 1.0 | 180 | 640 | 600~650 | 640 | 700° C. × 40 hr | Comparative Example |
| 32 | F | Ar3 + 10° C. | 0.6 | 220 | 610 | 540~610 | 560 | 640° C. × 40 hr | Comparative Example |

TABLE 3

| Steel sheet No. | Steel No. | Average fertile grain size (μm) | Average carbide grain size (μm) | Volume ratio of carbide larger than 2 μm in grain size (%) | Volume ratio of carbide-free ferrite | Hardness (HRB) | Hole-expanding ratio λ (%) | Tensile strength (MPa) | Elongation (%) | Remark |
|---|---|---|---|---|---|---|---|---|---|---|
| 1 | A | 5.8 | 0.75 | 6 | 5 | 73 | 148 | 440 | 43 | Example |
| 2 | B | 5.5 | 0.88 | 8 | 5 | 73 | 150 | 445 | 42 | Example |
| 3 | C | 3.6 | 0.59 | 4 | 3 | 79 | 80 | 490 | 38 | Example |
| 4 | D | 3.2 | 0.40 | 2 | 3 | 80 | 75 | 500 | 36 | Example |
| 5 | E | 2.9 | 0.47 | 3 | 2 | 86 | 56 | 560 | 32 | Example |
| 6 | F | 1.9 | 0.36 | 2 | 1 | 88 | 45 | 590 | 31 | Example |

TABLE 3-continued

| Steel sheet No. | Steel No. | Average fertile grain size (μm) | Average carbide grain size (μm) | Volume ratio of carbide larger than 2 μm in grain size (%) | Volume ratio of carbide-free ferrite | Hardness (HRB) | Hole-expanding ratio λ (%) | Tensile strength (MPa) | Elongation (%) | Remark |
|---|---|---|---|---|---|---|---|---|---|---|
| 7 | G | 5.0 | 0.65 | 7 | 4 | 75 | 90 | 470 | 40 | Example |
| 8 | H | 4.8 | 0.63 | 6 | 4 | 76 | 89 | 480 | 40 | Example |
| 9 | I | 3.0 | 0.50 | 3 | 2 | 85 | 60 | 550 | 33 | Example |
| 10 | J | 2.5 | 0.41 | 2 | 1 | 87 | 50 | 580 | 31 | Example |
| 11 | K | 3.6 | 0.57 | 3 | 3 | 79 | 79 | 490 | 38 | Example |
| 12 | L | 3.6 | 0.58 | 4 | 4 | 80 | 78 | 500 | 37 | Example |
| 13 | M | 3.6 | 0.59 | 4 | 3 | 78 | 81 | 480 | 39 | Example |
| 14 | N | 3.6 | 0.59 | 4 | 3 | 79 | 80 | 490 | 38 | Example |
| 15 | O | 3.6 | 0.59 | 4 | 3 | 79 | 79 | 490 | 38 | Example |
| 16 | P | 3.5 | 0.58 | 4 | 3 | 79 | 79 | 490 | 38 | Example |
| 17 | Q | 3.2 | 0.58 | 4 | 3 | 80 | 78 | 500 | 37 | Example |
| 18 | R | 3.2 | 0.59 | 4 | 3 | 79 | 80 | 490 | 38 | Example |
| 19 | A | 10.8 | 1.44 | 25 | 30 | 70 | 98 | 410 | 42 | Comparative Example |
| 20 | A | 6.8 | 0.90 | 9 | 20 | 72 | 118 | 435 | 40 | Comparative Example |
| 21 | A | 3.5 | 0.05 | 0 | 1 | 84 | 38 | 535 | 33 | Comparative Example |
| 22 | B | 6.5 | 0.94 | 11 | 8 | 72 | 138 | 430 | 40 | Comparative Example |
| 23 | B | 7.2 | 1.30 | 15 | 26 | 68 | 75 | 400 | 41 | Comparative Example |
| 24 | B | 6.5 | 0.88 | 8 | 16 | 72 | 70 | 430 | 40 | Comparative Example |
| 25 | C | 3.4 | 0.07 | 0 | 2 | 90 | 21 | 580 | 29 | Comparative Example |
| 26 | C | 3.6 | 1.10 | 11 | 5 | 79 | 45 | 490 | 32 | Comparative Example |
| 27 | D | 5.2 | 0.64 | 5 | 15 | 78 | 51 | 480 | 33 | Comparative Example |
| 28 | D | 2.1 | 0.04 | 0 | 0 | 92 | 20 | 600 | 27 | Comparative Example |
| 29 | E | 3.0 | 0.68 | 6 | 18 | 82 | 19 | 520 | 28 | Comparative Example |
| 30 | E | 5.2 | 1.39 | 22 | 15 | 80 | 20 | 500 | 29 | Comparative Example |
| 31 | F | 3.9 | 1.38 | 21 | 6 | 84 | 10 | 530 | 27 | Comparative Example |
| 32 | F | 3.0 | 0.08 | 1 | 6 | 89 | 11 | 580 | 25 | Comparative Example |

What is claimed is:

1. A method for manufacturing a high carbon hot-rolled steel sheet comprising the steps of:

hot-rolling a steel comprising, in terms of percentages of mass, 0.10 to 0.70% C, 2.0% or less Si, 0.20 to 2.0% Mn, 0.03% or less P, 0.03% or less S, 0.1% or less Sol.Al, 0.01% or less N, at least one element selected from the group consisting of 0.05 to 1.5% Cr and 0.01 to 0.5% Mo and the balance being Fe and inevitable impurities, at a finishing temperature of (Ar, transformation point −10° C.) or more to provide a hot-rolled steel sheet;

applying primary cooling to the hot-rolled steel sheet down to a cooling termination temperature ranging from 450° C. to 600° C. at a cooling rate of more than 120° C./sec to provide a primarily cooled hot-rolled steel sheet;

applying a secondary cooling and impeding transformation generated temperature increases in the primarily cooled hot-rolled steel sheet after primary cooling, wherein, even when the primary cooling termination temperature is lower than 600° C., temperatures between the primary cooling termination and coiling increase to higher than 650° C. accompanied by proeutectoid ferrite transformation, pearlite transformation and bainite transformation, by holding the temperature of the primarily cooled hot-rolled steel sheet for 5 seconds to less than 60 seconds to complete transformation and in a temperature range from 450° C. to 650° C. until coiling to provide a cooled hot-rolled steel sheet;

coiling the cooled hot-rolled steel sheet at coiling temperatures of 600° C. or less to provide a coiled hot-rolled steel sheet; and annealing the hot-rolled steel sheet at an annealing temperature ranging from 680° C. to the $Ac_1$ transformation point, such that the high carbon hot-rolled steel sheet contains ferrite having an average grain size of 6 μm or less and carbide having an average grain size of 0.10 μm or more and less than 1.2 μm;

the carbide having a volume ratio of 10% or less regarding a grain size of 2.0 μm or more; and the ferrite containing no carbide having a volume ratio of 5% or less.

2. The method according to claim 1, wherein the cooling rate in the primary cooling step is in a range from 120 to 700° C./sec.

3. The method according to claim 1, wherein the coiling temperature is in a range from 200° C. to 600° C.

4. The method according to claim 2, wherein the coiling temperature is in a range from 200° C. to 600° C.

* * * * *